US010669735B2

(12) United States Patent
Johnson

(10) Patent No.: US 10,669,735 B2
(45) Date of Patent: Jun. 2, 2020

(54) MARKER STABILIZER

(71) Applicant: Matthew Johnson, Sudbury, MA (US)

(72) Inventor: Matthew Johnson, Sudbury, MA (US)

( * ) Notice: Subject to any disclaimer, the term of this patent is extended or adjusted under 35 U.S.C. 154(b) by 223 days.

(21) Appl. No.: 15/690,922

(22) Filed: Aug. 30, 2017

(65) Prior Publication Data

US 2019/0063104 A1 Feb. 28, 2019

Related U.S. Application Data

(60) Provisional application No. 62/551,050, filed on Aug. 28, 2017.

(51) Int. Cl.
*E04H 12/22* (2006.01)
*E01F 9/677* (2016.01)
*E01F 9/608* (2016.01)

(52) U.S. Cl.
CPC ..... *E04H 12/2269* (2013.01); *E01F 9/608* (2016.02); *E01F 9/677* (2016.02)

(58) Field of Classification Search
CPC ..... E04H 12/2269; E01F 9/608; E01F 9/677
See application file for complete search history.

(56) References Cited

U.S. PATENT DOCUMENTS 191,919 A * 6/1877 Bonner ..... E04H 13/003 52/103
365,264 A 6/1887 Levering
401,782 A * 4/1889 Howlett ..... E04H 13/003 52/103
427,394 A * 5/1890 Brown ..... E04H 13/003 52/103
888,917 A * 5/1908 Lucas ..... E02D 5/801 52/157
2,560,951 A * 7/1951 Henderson ..... F16B 37/122 52/705
2,687,788 A * 8/1954 Rapp ..... G01C 15/04 52/103
2,920,855 A 1/1960 Giebel
3,166,041 A * 1/1965 Caggainello ..... B65D 90/48 116/209
3,205,626 A * 9/1965 Attenberger ..... G01C 15/04 52/103
3,279,133 A * 10/1966 De Korte ..... E01F 9/629 52/103
3,507,081 A * 4/1970 Gallup ..... G01C 15/06 52/103

(Continued)

OTHER PUBLICATIONS

Driveway Markers , "Mighty Marker Mount—Five (5) Pack in Green," retrieved on Mar. 9, 2020 (5 pages).

(Continued)

*Primary Examiner* — Nimeshkumar D Patel
*Assistant Examiner* — Tania Courson
(74) *Attorney, Agent, or Firm* — Clark & Elbing LLP

(57) ABSTRACT

Described herein are systems, methods, and kits useful in stabilizing markers, such as driveway markers or garden stakes, that are placed in the ground. The invention comprises a marker stabilizer that can be inserted into the ground and that can receive a marker within an interior channel. The invention also comprises a cap that can be used to protect the marker stabilizer and a marker stabilizer remover that can be used to pull the marker stabilizer out of the ground.

19 Claims, 7 Drawing Sheets

(56) References Cited

U.S. PATENT DOCUMENTS 3,612,287 A * 10/1971 Maltese ..... A47F 5/04 52/298
3,685,237 A * 8/1972 Johnson ..... G01C 15/06 52/98
3,688,454 A * 9/1972 Wolfcarius ..... G01C 15/04 52/103
3,767,355 A 10/1973 Anderson, Jr.
3,902,818 A 9/1975 Boone
D246,513 S * 11/1977 Garneau ..... D10/66
4,240,766 A * 12/1980 Smith ..... E01F 9/677 248/160
4,251,963 A * 2/1981 Patterson ..... E02D 5/803 52/157
4,982,701 A * 1/1991 Papak ..... A01K 1/04 119/786
5,090,348 A 2/1992 Hugron
5,148,641 A * 9/1992 Rushing ..... G01C 15/04 52/103
5,165,663 A * 11/1992 Wells ..... E04H 12/2215 256/1
5,186,119 A * 2/1993 Hlavin ..... A63C 19/062 116/201
5,207,175 A 5/1993 Andonian
5,257,762 A 11/1993 Trame et al.
5,295,766 A * 3/1994 Tiikkainen ..... E02D 5/34 405/232
5,303,931 A * 4/1994 Brown ..... A63B 63/00 116/173
5,662,304 A * 9/1997 McDaniel ..... E04H 12/2223 248/499
5,809,700 A * 9/1998 Roush ..... E04H 15/003 135/117
5,906,077 A * 5/1999 Andiarena ..... E04H 12/2223 135/118
6,129,322 A 10/2000 Merkl
6,267,529 B1 7/2001 Mudryk et al.
6,267,688 B1 * 7/2001 Morelli, Sr. ..... A63B 57/40 473/179
6,321,679 B1 * 11/2001 Murrin ..... G02B 6/4442 116/209
7,249,910 B2 * 7/2007 Eckert ..... E01F 9/685 248/158
7,497,053 B2 * 3/2009 Nicolet ..... E02D 5/74 248/545
7,631,447 B2 * 12/2009 Morton ..... G09F 15/00 116/209
7,930,859 B1 * 4/2011 Eslambolchi ..... E01F 9/629 248/159
7,950,200 B2 * 5/2011 Tropiano ..... E04H 12/2223 135/98
8,096,368 B1 * 1/2012 Rider ..... E04H 17/263 173/1
8,177,185 B2 5/2012 Priegel
9,945,078 B2 * 4/2018 Harra.beta ..... E01B 9/18
10,077,893 B1 * 9/2018 Abraham ..... A45F 3/44
10,145,505 B2 * 12/2018 Wasley ..... E21F 17/18
10,287,793 B1 * 5/2019 Anslem ..... E04H 12/2215
10,352,061 B2 * 7/2019 Geslin ..... E04H 12/2223
2003/0226495 A1 12/2003 Courtemanche
2004/0163336 A1 * 8/2004 Hsu ..... E04H 12/2223 52/157
2004/0169121 A1 * 9/2004 Winn ..... A45B 1/00 248/530
2008/0008555 A1 * 1/2008 Ardern ..... E04H 12/2223 411/411
2010/0143034 A1 6/2010 Yeghiayan et al.
2011/0293367 A1 12/2011 Yeghiayan et al.
2012/0110862 A1 5/2012 Mann
2013/0340670 A1 12/2013 Vogt
2015/0090857 A1 * 4/2015 Walker ..... E04H 12/2238 248/535
2015/0096260 A1 * 4/2015 Intagliata ..... E04H 12/347 52/741.14
2015/0197902 A1 7/2015 Yeghiayan et al.
2015/0315753 A1 11/2015 Baltazar
2017/0089509 A1 * 3/2017 Bailey ..... F16B 7/182

OTHER PUBLICATIONS

Rebound Driveway Marker, Marker + Mount: Smart All-in-one Solution: Spike Base & Marker Combo, retrieved on Mar. 9, 2020 (2 pages).
Rebound Driveway Marker, Spring-based rod rebounds when hit by car or plow, retrieved on Mar. 9, 2020 (2 pages).

* cited by examiner

MARKER STABILIZER

BACKGROUND OF THE INVENTION

Markers are frequently inserted into the ground for use as positional indicators. Driveway markers are one such example and can be used to mark the location of areas that can safely be plowed after snowfall. Garden stakes are another type of marker, which can be used to indicate the location of different types of plants or to support growing plants by keeping them upright. The use of these markers can be challenging due to their tendency to fall over and difficulties with their insertion into frozen ground and maintenance during inclement weather. It can also be difficult to hammer long, flexible markers into the ground. Thus, there exists a need for a device that can stabilize markers and facilitate their insertion into the ground.

SUMMARY OF THE INVENTION

The present invention provides systems, methods, and kits for stabilizing markers that are typically inserted directly into the ground. In one aspect, the invention features a system including a marker stabilizer for insertion into the ground, in which the marker stabilizer contains a body having an open top at a first end, an interior channel extending longitudinally through all or a portion of the body that contains internal threads, and a closed, pointed tip at a distal end of the body; and a cap containing a top surface, sides containing grooves, and a flat bottom side containing a medial protrusion having a longitudinal length and external threads along the longitudinal length, in which the cap is configured to be removably attached to the marker stabilizer by contacting the external threads of the protrusion to the internal threads of the body.

In some embodiments, the system further includes a marker that is configured to be removably inserted into the interior channel of the marker stabilizer and extend through all or a portion of the interior channel.

In some embodiments, the system further includes a marker stabilizer remover that contains a handle having a top surface, side surfaces, and a bottom surface containing a medial protrusion having a longitudinal length and external threads along the longitudinal length, in which the marker stabilizer remover is configured to be removably attached to the marker stabilizer by contacting the external threads of the protrusion of the marker stabilizer remover to the internal threads of the body of the marker stabilizer.

In another aspect, the invention features a method for using a marker stabilizer system, which includes: (a) inserting a marker stabilizer into the ground until the top of the stabilizer is substantially flush with the ground, in which the marker stabilizer comprises a body having an open top at a first end; an interior channel extending longitudinally through all or a portion of the body and comprising internal threads; and a closed, pointed tip at a distal end of the body; and (b) inserting a marker into the body of the marker stabilizer, in which the marker is configured to be removably inserted into the interior channel of the marker stabilizer and to extend through all or a portion of the interior channel.

In some embodiments, the marker stabilizer system further includes a cap containing a top surface; sides containing grooves; and a flat bottom side containing a medial protrusion having a longitudinal length and external threads along the longitudinal length, in which the cap is configured to be removably attached to the marker stabilizer by contacting the external threads of the medial protrusion of the cap to the internal threads of the body, and the method further includes removing the marker from the interior channel of the marker stabilizer and twisting the medial protrusion of the cap into the interior channel of the marker stabilizer until the bottom side of the cap contacts the top of the marker stabilizer and forms a seal.

In some embodiments, the marker stabilizer system further includes a marker stabilizer remover containing a handle having a top surface; side surfaces; and a bottom surface containing a medial protrusion having a longitudinal length and external threads along the longitudinal length, in which the marker stabilizer remover is configured to be removably attached to the marker stabilizer by contacting the external threads of the medial protrusion of the marker stabilizer remover to the internal threads of the body, and the method further includes removing the marker from the interior channel of the marker stabilizer and twisting the medial protrusion of the marker stabilizer remover into the interior channel of the marker stabilizer until the medial protrusion extends approximately halfway into the interior channel.

In some embodiments, the marker stabilizer system further includes a marker stabilizer remover containing a handle having a top surface; side surfaces; and a bottom surface containing a medial protrusion having a longitudinal length and external threads along the longitudinal length, in which the marker stabilizer remover is configured to be removably attached to the marker stabilizer by contacting the external threads of the medial protrusion of the marker stabilizer to the internal threads of the body, and the method further includes twisting the cap in the opposite direction until the medial protrusion of the cap is fully removed from the interior channel of the marker stabilizer and twisting the medial protrusion of the marker stabilizer remover into the interior channel of the marker stabilizer until the medial protrusion of the marker stabilizer remover extends approximately halfway into the interior channel.

In some embodiments, the method further includes gripping the handle of the marker stabilizer remover, pulling up on the handle until the marker stabilizer is completely removed from the ground, and twisting the marker stabilizer remover in the opposite direction until the medial protrusion of the marker stabilizer remover is fully removed from the interior channel of the marker stabilizer.

In another aspect, the invention features a marker stabilizer kit containing a marker stabilizer for insertion into the ground, in which the stabilizer contains a body having an open top at a first end, an interior channel extending longitudinally through all or a portion of the body and containing internal threads, and a closed, pointed tip at a distal end of the body; a cap containing a top surface, sides containing grooves, and a flat bottom side containing a medial protrusion having a longitudinal length and external threads along the longitudinal length, in which the cap is configured to be removably attached to the marker stabilizer by contacting the external threads of the medial protrusion of the cap to the internal threads of the body; and a marker stabilizer remover, in which the marker stabilizer remover contains a handle having a top surface, side surfaces, and a bottom surface containing a medial protrusion having a longitudinal length and external threads along the longitudinal length, in which the marker stabilizer remover is configured to be removably attached to the marker stabilizer by contacting the external threads of the medial protrusion of the marker stabilizer remover to the internal threads of the body.

In some embodiments of any of the above aspects, the marker stabilizer has a length of 10 cm to 20 cm. In some embodiments, the marker stabilizer has a length of 15 cm. In some embodiments of any of the above aspects, the marker stabilizer has a diameter of 1 cm to 5 cm. In some embodiments, the marker stabilizer has a diameter of 2 cm.

In some embodiments of any of the above aspects, the internal threads begin at the top of the body of the marker stabilizer.

In some embodiments of any of the above aspects, the interior channel has a length of 8 cm to 15 cm. In some embodiments, the interior channel has a length of 12 cm. In some embodiments of any of the above aspects, the interior channel has a diameter of 0.5 cm to 1.5 cm. In some embodiments, the interior channel has a diameter of 1 cm.

In some embodiments of any of the above aspects, the internal threads extend through an entire length of the interior channel.

In some embodiments of any of the above aspects, the body of the marker stabilizer is round, square, triangular, or multi-sided.

In some embodiments of any of the above aspects, the closed tip is solid. In some embodiments of any of the above aspects, the closed tip has angled sides that terminate in one or more points. In some embodiments of any of the above aspects, the closed tip terminates in one point. In some embodiments of any of the above aspects, the closed tip terminates in more than one point. In some embodiments of any of the above aspects, the closed tip terminates in the shape of an "x" or the shape of a "+."

In some embodiments of any of the above aspects, the cap has a diameter of 0.25 cm to 5 cm. In some embodiments, the cap has a diameter of 2.115 cm. In some embodiments of any of the above aspects, the cap has a height of 0.25 cm to 2 cm. In some embodiments, the cap has a height of 0.4 cm.

In some embodiments of any of the above aspects, the medial protrusion of the cap has a diameter of 0.25 cm to 2 cm. In some embodiments, the medial protrusion of the cap has a diameter of 1.065 cm. In some embodiments of any of the above aspects, the medial protrusion of the cap has a length of 0.25 cm to 2 cm. In some embodiments, the medial protrusion of the cap has a length of 0.4 cm. In some embodiments of any of the above aspects, the cap has the shape of a circle, square, or oval, or is multi-sided.

In some embodiments of any of the above aspects, the bottom side of the cap is configured to contact the top of the marker stabilizer and form a seal when the medial protrusion of the cap is engaged in the interior channel of the marker stabilizer.

In some embodiments of any of the above aspects, the marker extends through an entire length of the channel. In some embodiments of any of the above aspects, the marker is a driveway marker. In some embodiments of any of the above aspects, the marker is a garden stake. In some embodiments of any of the above aspects, the marker is a decoration.

In some embodiments of any of the above aspects, the handle has a width of 0.5 cm to 4 cm. In some embodiments, the handle has a width of 1 cm. In some embodiments of any of the above aspects, the handle has a length of 0.5 cm to 10 cm. In some embodiments, the handle has a length of 5 cm. In some embodiments of any of the above aspects, the handle has a height of 0.25 cm to 2 cm. In some embodiments, the handle has a height of 0.5 cm. In some embodiments of any of the above aspects, the handle contains indentations configured for gripping with fingers.

In some embodiments of any of the above aspects, the medial protrusion of the marker stabilizer remover has a diameter of 0.5 cm to 2 cm. In some embodiments, the medial protrusion of the marker stabilizer remover has a diameter of 1.065 cm. In some embodiments of any of the above aspects, the medial protrusion of the marker stabilizer remover has a length of 1 cm to 10 cm. In some embodiments, the medial protrusion of the marker stabilizer remover has a length of 4.55 cm.

In some embodiments of any of the above aspects, the medial protrusion of the marker stabilizer remover is configured to partially extend into the interior channel of the marker stabilizer when the medial protrusion of the marker stabilizer remover is engaged in the interior channel.

In some embodiments of any of the above aspects, the marker stabilizer, cap, or marker stabilizer remover are made of plastic. In some embodiments of any of the above aspects, the marker stabilizer, cap, or marker stabilizer remover are made of metal.

DETAILED DESCRIPTION

Figure 1:
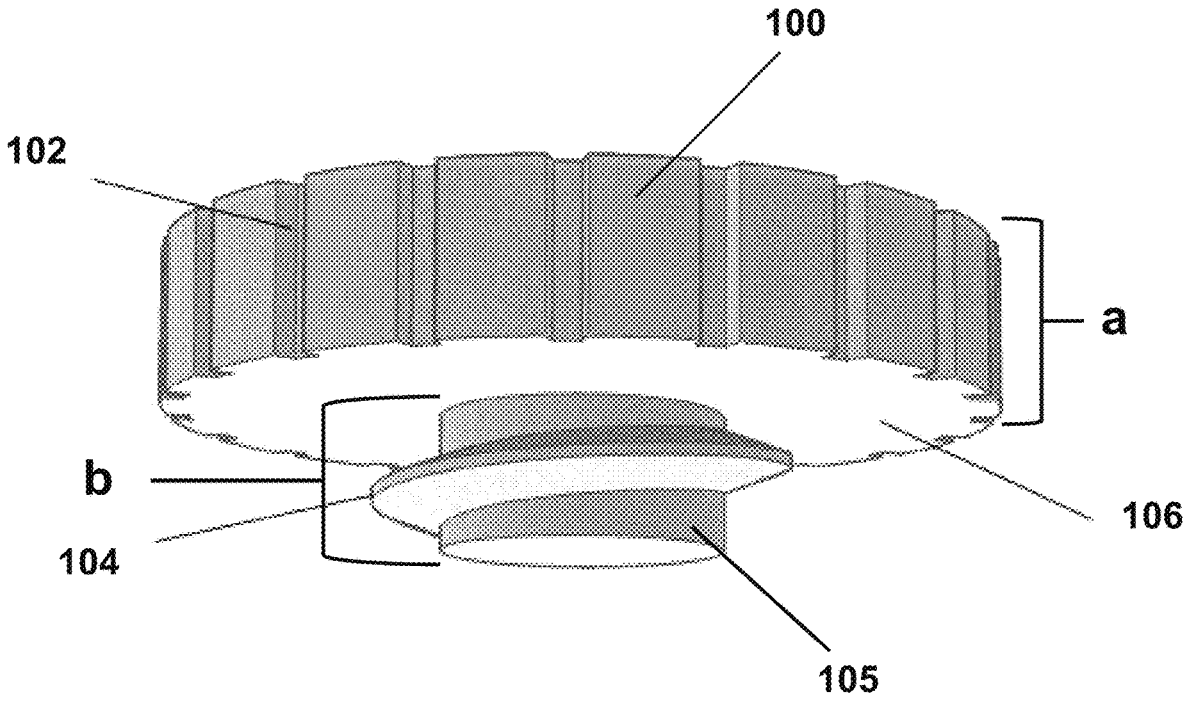
FIG. 1 is a side elevation view of cap (100) with a top surface and sides having height (a) and containing grooves (102) that make cap (100) easier to grip. Bottom side (106) of cap (100) is flat and contains medial protrusion (105) having longitudinal length (b) and external threads (104). Cap (100) can attach to marker stabilizer (108) via medial protrusion (105) to provide protection from debris, dirt, or other environmental particulates.

Described herein are systems, methods, and kits for stabilizing markers (e.g., driveway markers, garden stakes, or decorations). The systems, methods, and kits feature a marker stabilizer that can be left in the ground year round. The marker stabilizer is made up of a body having an open top at a first end; an interior channel extending longitudinally through all or a portion of the body that contains internal threads; and a closed, pointed tip at a distal end of the body. The internal channel can contain one or more (e.g., 2, 3, 4, or more) internal threads, and the pointed tip may terminate in one or more (e.g., 2, 3, 4, or more) points. The marker stabilizer can be inserted (e.g., hammered) into the ground until the top of the marker stabilizer is substantially flush with the surface of the ground, and a marker (e.g., a driveway marker, garden stake, or decoration) can be inserted into the interior channel of the marker stabilizer by sliding or twisting the marker into the interior channel. The marker can be inserted so that it extends through all or a portion of the interior channel.

The system can also include a cap having a top surface; sides containing grooves; and a flat bottom side containing a medial protrusion having a longitudinal length and one or more (e.g., 2, 3, 4, or more) external threads along the longitudinal length. The cap is configured to be removably attached to the marker stabilizer by contacting the external threads of the protrusion to the internal threads of the body when the marker stabilizer is not in use (e.g., when a marker is not inserted into the interior channel of the marker stabilizer) to prevent dirt or debris from getting inside the interior channel of the marker stabilizer. The cap is twisted onto the marker stabilizer until the bottom side of the cap contacts the top of the marker stabilizer, forming a seal. The system may further include a marker stabilizer remover, which is made up of a handle having a top surface; side surfaces; and a bottom surface containing a medial protrusion having a longitudinal length and one or more (e.g., 2, 3, 4, or more) external threads along the longitudinal length. The marker stabilizer remover is configured to be removably attached to the marker stabilizer when not in use (e.g., when a marker or cap is not inserted into the interior channel of the marker stabilizer) by contacting the external threads of the protrusion to the internal threads of the body. Once the marker stabilizer remover has been at least partially twisted into the interior channel of the marker stabilizer, pulling on the handle of the marker stabilizer remover will remove the marker stabilizer from the ground. The marker stabilizer can then be separated from the marker stabilizer remover by twisting the remover in the opposite direction, and the marker stabilizer can be inserted into the ground in a new location or re-used as desired.

Marker Stabilizer System

The systems described herein include marker stabilizer (108), which can be inserted (e.g., hammered) into the ground until the top of body (107) is flush with the ground. Interior channel (110) of marker stabilizer (108) can hold marker (120), which represents a marker (e.g., a driveway marker, garden stake, or decoration) that would otherwise be inserted directly into the ground. When marker stabilizer (108) is not being used to hold a marker, cap (100) can be used to prevent dirt, debris, or other environmental particulates from entering interior channel (110) by contacting interior channel (110) with medial protrusion (105) and twisting until bottom side (106) of cap (100) contacts the top of marker stabilizer (108) and forms a seal. Cap (100) can be removed by twisting in the opposite direction. After removal of cap (100), marker stabilizer (108) can again be used hold a marker.

If marker stabilizer (108) needs to be removed from the ground for storage or insertion in a different location, marker stabilizer remover (114) can be used to pull it from the ground. Marker stabilizer remover (114) can be attached to marker stabilizer (108) by contacting external threads (119) of medial protrusion (118) to internal threads (111) of interior cavity (110) and twisting until medial protrusion (118) is approximately halfway inside interior cavity (110). A user (e.g., a homeowner, landlord, or gardener) can then remove marker stabilizer (108) from the ground by pulling on handle (116) of marker stabilizer remover (114) until marker stabilizer (108) is completely removed from the ground. Marker stabilizer remover (114) can be twisted in the opposite direction for removal from marker stabilizer (108). The components of the marker stabilizer system are described herein below.

Marker Stabilizer

Figure 2:
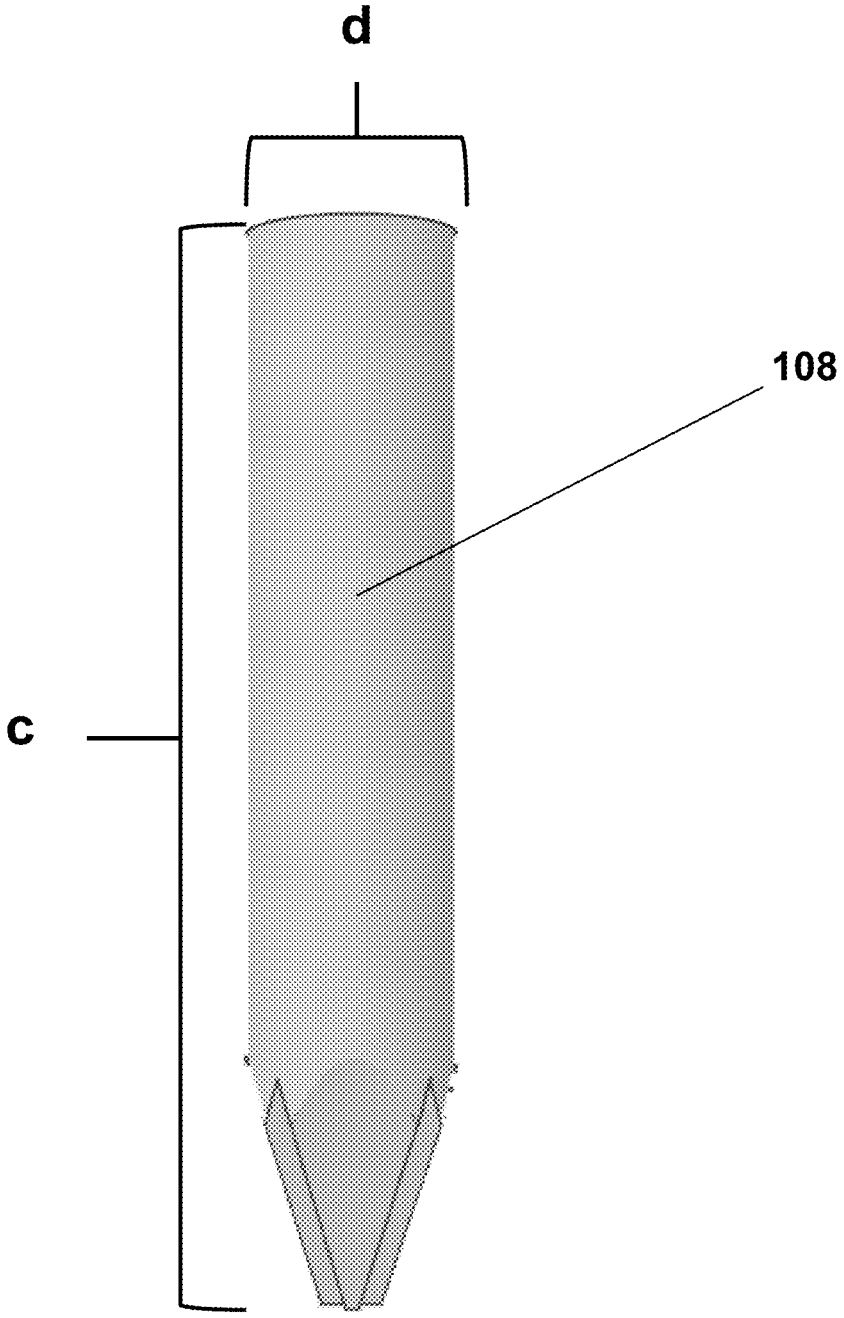
FIG. 2 is a side view of marker stabilizer (108) with length (c) and diameter (d).
Figure 3:
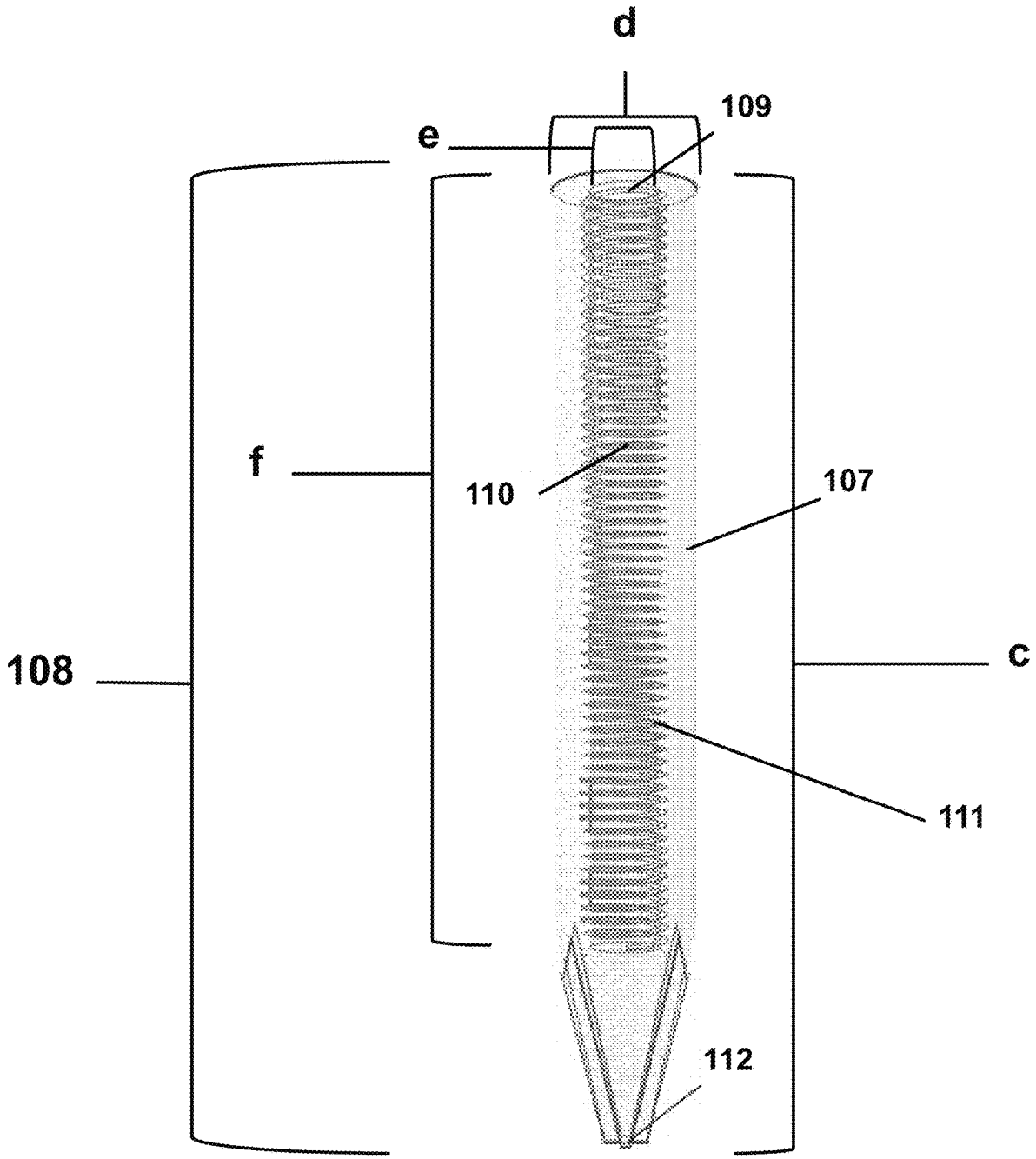
FIG. 3 is a side view of marker stabilizer (108) in which the interior channel is visible through the side walls. Marker stabilizer (108) has open top (109) with diameter (e) and interior channel (110) that extends longitudinally through body (107) and has length (f). Interior channel (110) contains internal threads (111). Marker stabilizer (108) has pointed tip (112) at the distal end of body (107). Internal threads (111) are used to engage cap (100) and marker stabilizer remover (114) with marker stabilizer (108).

Marker stabilizer (108) is made up of body (107) having open top (109) at a first end, interior channel (110) extending longitudinally through all or a portion of body (107) and containing internal threads (111), and closed, pointed tip (112) at a distal end of body (107) (FIGS. 2-3). Internal threads (111) can be used to engage cap (100) or marker stabilizer remover (114). Pointed tip (112) allows marker stabilizer (108) to be easily inserted into the ground. Marker stabilizer (108) has width (d) of 1 cm to 5 cm (e.g., 1, 1.5, 2, 2.5, 3, 3.5, 4, 4.5, or 5 cm) and length (c) of 10 cm to 20 cm (e.g., 10, 11, 12, 13, 14, 15, 16, 17, 18, 19, or 20 cm). Interior channel (110) has width (e) of 0.5 cm to 1.5 cm (e.g., 0.5, 0.75, 1, 1.25, or 1.5 cm) and length (f) of 8 cm to 15 cm (e.g., 8, 9, 10, 11, 12, 13, 14, or 15 cm). When marker stabilizer (108) and interior channel (110) are round (e.g., in the shape of a circle), widths (d) and (e) represent the diameter.

Pointed tip (112) has angled sides that terminate in one or more (e.g., 2, 3, 4, or more) points. In some embodiments, pointed tip (112) terminates in the shape of an "x" or the shape of a "+." Pointed tip (112) may be solid or hollow, and more or less elongated than shown in FIGS. 2-3. The angled sides of pointed tip (112) may form an angle between 90° and 180° (e.g., 100°, 110°, 120°, 130°, 140°, 150°, 160°, or 170°) with the side of marker stabilizer (108).

Marker stabilizer (108) may be in the shape of a circle (forming a cylindrical shape, as shown in FIG. 2). Alternatively, marker stabilizer (108) may be in the shape of a square (forming a rectangular prism shape) or a triangle (forming a triangular prism shape). Marker stabilizer (108) may also be multi-sided (e.g., 3, 4, 5, 6, 7, 8, 9, or 10-sided). Marker stabilizer (108) can also contain dots or a line on the top or side of body (107) to indicate where to align cap (100) or marker stabilizer remover (114) for twisting onto marker stabilizer (108). Internal threads (111) of interior channel (110) may extend through an entire length of interior channel (110) or only through a portion of the channel (e.g., one quarter, one half, or three quarters of interior channel (110)) starting from open top (109). Internal threads (111) can be made up of one or more sets (e.g., 2, 3, 4, or more) of threads, and may be spaced closer together or further apart than shown in FIG. 3.

Marker stabilizer (108) may be made of any plastic or metal that can be formed into the shape of a marker stabilizer. Materials used to make marker stabilizer (108) can be opaque or transparent and can be of any color.

Cap

Figure 5:
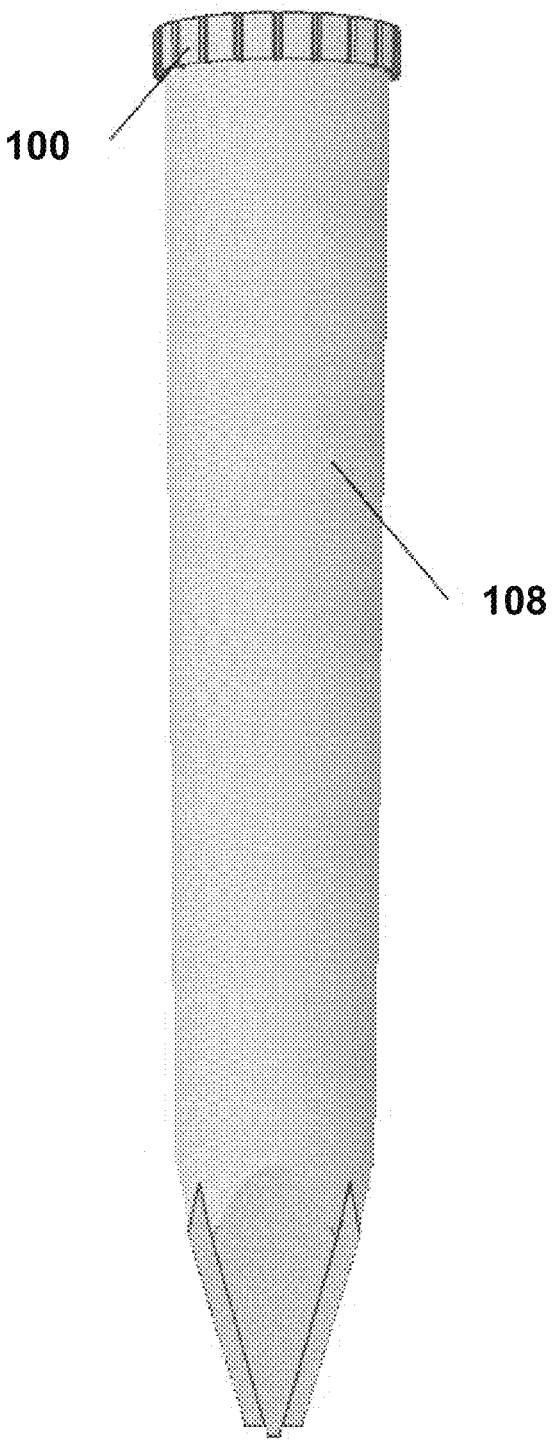
FIG. 5 is a side view of marker stabilizer (108) engaged with cap (100). Cap (100) can be removably attached to marker stabilizer (108) by contacting external threads (104) of cap (100) to internal threads (111) of marker stabilizer (108), and twisting until bottom side (106) of cap (100) contacts the top of marker stabilizer (108) to form a seal.
Figure 6:
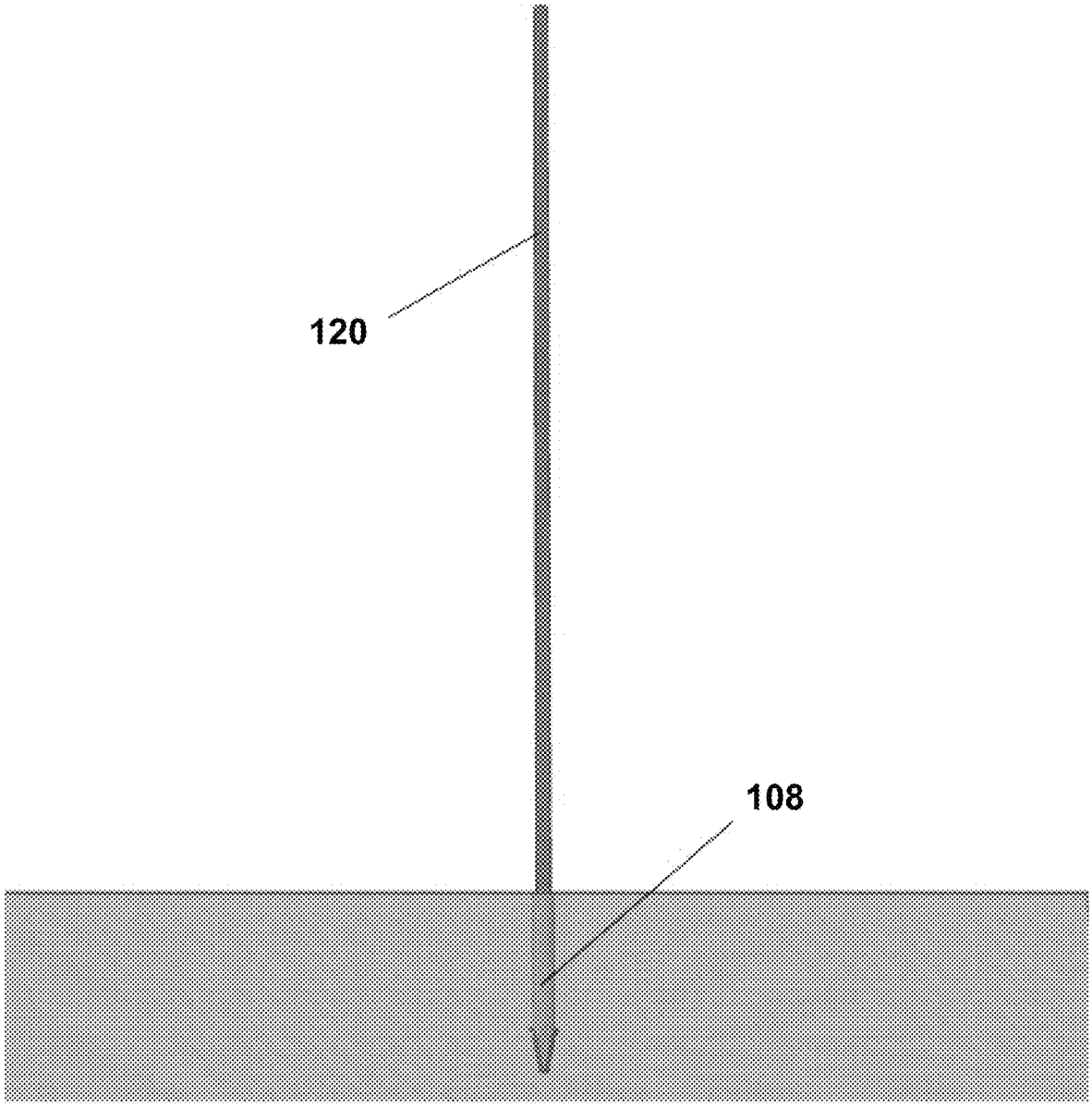
FIG. 6 is a side view of marker stabilizer (108) in the ground holding marker (120). The top of marker stabilizer (108) is flush with the ground and marker (120) is inserted into interior channel (110) of marker stabilizer (108). Marker (120) can be a driveway marker, garden stake, or decoration.

Cap (100) has a top surface; sides containing grooves (102); and flat bottom side (106) containing medial protrusion (105) having longitudinal length (b) and external threads (104) along the longitudinal length. The top surface of cap (100) can be flat. Cap (100) is configured to be removably attached to marker stabilizer (108) by contacting external threads (104) of medial protrusion (105) to internal threads (111) of interior channel (110). Cap (100) may be attached by twisting medial protrusion (105) into interior channel (110) until bottom side (106) of cap (100) contacts the top of the body of marker stabilizer (108) and forms a seal, as shown in FIG. 5. Cap (100) can be removed from marker stabilizer (108) by twisting in the reverse direction.

The top and bottom of cap (100) are the same size and have a width of 0.25 cm to 5 cm (e.g., 0.25, 0.5, 0.75, 1.0, 1.25, 1.5, 1.75, 2.0, 2.115, 2.25, 2.5, 2.75, 3.0, 3.25, 3.5, 3.75, 4.0, 4.25, 4.5, 4.75, or 5.0 cm). Cap (100) has height (a) of 0.25 cm to 2 cm (e.g., 0.25, 0.4, 0.5, 0.75, 1.0, 1.25, 1.5, 1.75, or 2 cm). Medial protrusion (105) has a width of 0.25 cm to 2 cm (e.g., 0.25, 0.4, 0.5, 0.75, 1.0, 1.065, 1.25, 1.5, 1.75, or 2 cm) and height (b) of 0.25 cm to 2 cm (e.g., 0.25, 0.4, 0.5, 0.75, 1.0, 1.065, 1.25, 1.5, 1.75, or 2 cm). When cap (100) or medial protrusion (105) are in the shape of a circle, the width is the diameter of the circle.

Cap (100) may be in the shape of a circle, as shown in FIG. 1, or may be in the shape of an oval or a square. Cap (100) may also be multi-sided (e.g., 3, 4, 5, 6, 7, 8, 9, or 10-sided). The side surfaces of cap (100) may not have any grooves. There may be dots or a line on the top surface of cap (100) indicating where to align cap (100) to twist onto marker stabilizer (108). Aligning the dots or lines on cap (100) and marker stabilizer (108) may facilitate attachment of these two components. The corners between the top surface and side surface, or bottom surface and side surface of cap (100) may form a 90° angle. The corners may also be rounded. External threads (104) can be made up of one or more sets (e.g., 2, 3, 4, or more) of threads, and may be spaced closer together or further apart than shown in FIG. 1.

Cap (100) may be made of any plastic or metal that can be formed into the shape of a cap. Materials used to make cap (100) can be opaque or transparent and can be of any color.

Cap (100) can also be attached to marker stabilizer (108) using a connector, e.g., a chain, a rope, a leash or other connector, that extends from cap (100) to body (107) of marker stabilizer (108). The connector prevents cap (100) from being lost when not engaged with marker stabilizer (108). The connector can extend from the top or near the top of the side of body (107) of marker stabilizer (108) to the top or side of cap (100). The connector can be plastic, metal, or fabric.

Marker Stabilizer Remover

Figure 7:
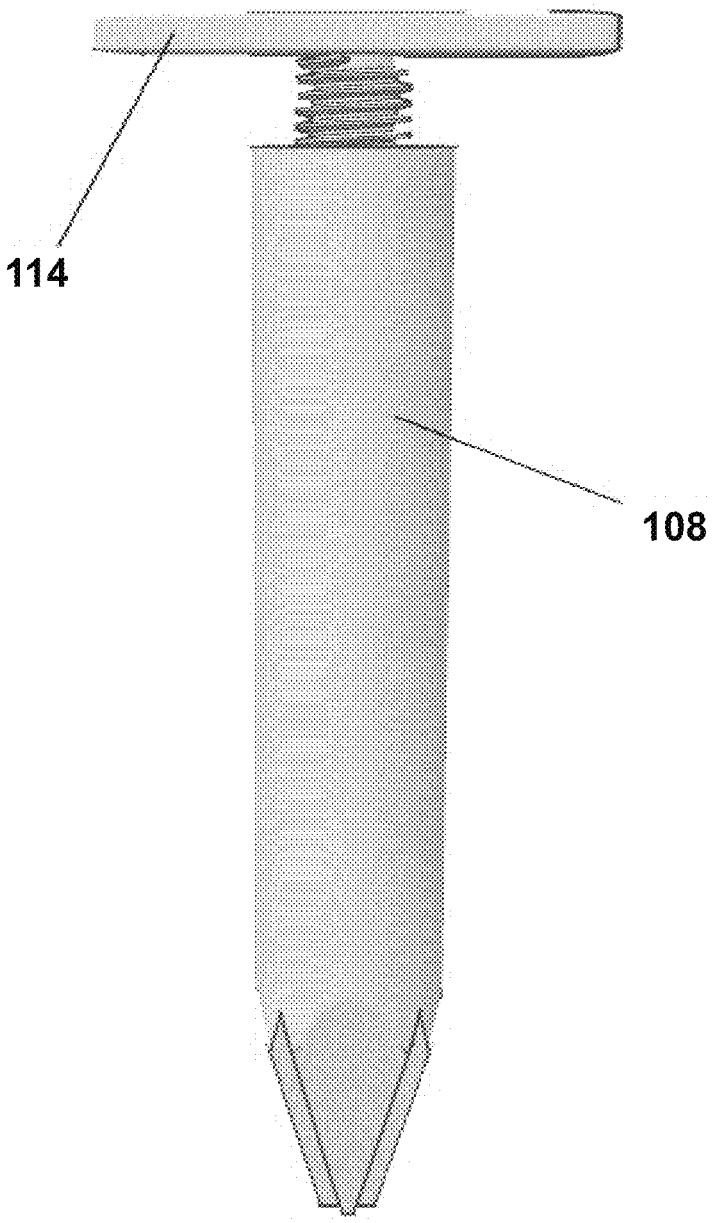
FIG. 7 is a side view of marker stabilizer remover (114) partially inserted into marker stabilizer (108). To achieve this configuration, external threads (119) of protrusion (118) are contacted to internal threads (111) of marker stabilizer (108), and marker stabilizer remover (114) is twisted until protrusion (118) is approximately halfway inserted into interior channel (110) of marker stabilizer (108). Once marker stabilizer remover (114) is at least partially inserted into marker stabilizer (108), a user can grip handle (116) and pull marker stabilizer (108) out of the ground.

Marker stabilizer remover (114) contains handle (116) having height (g); a top surface; side surfaces; and a bottom surface containing medial protrusion (118) having longitudinal length (h) and external threads (119) along the longitudinal length. Marker stabilizer remover (114) is configured to be removably attached to marker stabilizer (108) by contacting external threads (119) of medial protrusion (118) to internal threads (111) of interior channel (110). Marker stabilizer remover (114) may be attached by twisting medial protrusion (118) into interior channel (110) until medial protrusion (118) is partially inserted (e.g., one quarter, one half, or three quarters of length (h) inserted) into interior channel (110), as shown in FIG. 7. Marker stabilizer remover (114) can be removed from marker stabilizer (108) by twisting in the reverse direction.

The top and bottom of handle (116) are the same size and have a length of 0.5 cm to 10 cm (e.g., 0.5, 1.0, 1.5, 2.0, 2.5, 3.0, 3.5, 4.0, 4.5, 5.0, 5.5, 6.0, 6.5, 7.0, 7.5, 8.0, 8.5, 9.0, 9.5, or 10 cm) and a width of 0.5 cm to 4 cm (e.g., 0.5, 1.0, 1.5, 2.0, 2.5, 3.0, 3.5, or 4.0 cm). Handle (116) has a height (g) of 0.25 cm to 2 cm (e.g., 0.25, 0.5, 0.75, 1.0, 1.25, 1.5, 1.75, or 2 cm). Medial protrusion (118) has a width of 0.5 cm to 2 cm (e.g., 0.5, 0.75, 1.0, 1.065, 1.25, 1.5, 1.75, or 2 cm) and a length (h) of 1 cm to 10 cm (e.g., 0.5, 1.0, 1.5, 2.0, 2.5, 3.0, 3.5, 4.0, 4.5, 4.55, 5.0, 5.5, 6.0, 6.5, 7.0, 7.5, 8.0, 8.5, 9.0, 9.5, or 10 cm). When medial protrusion (118) is in the shape of a circle (e.g., round) the width is the diameter of the circle.

Figure 4:
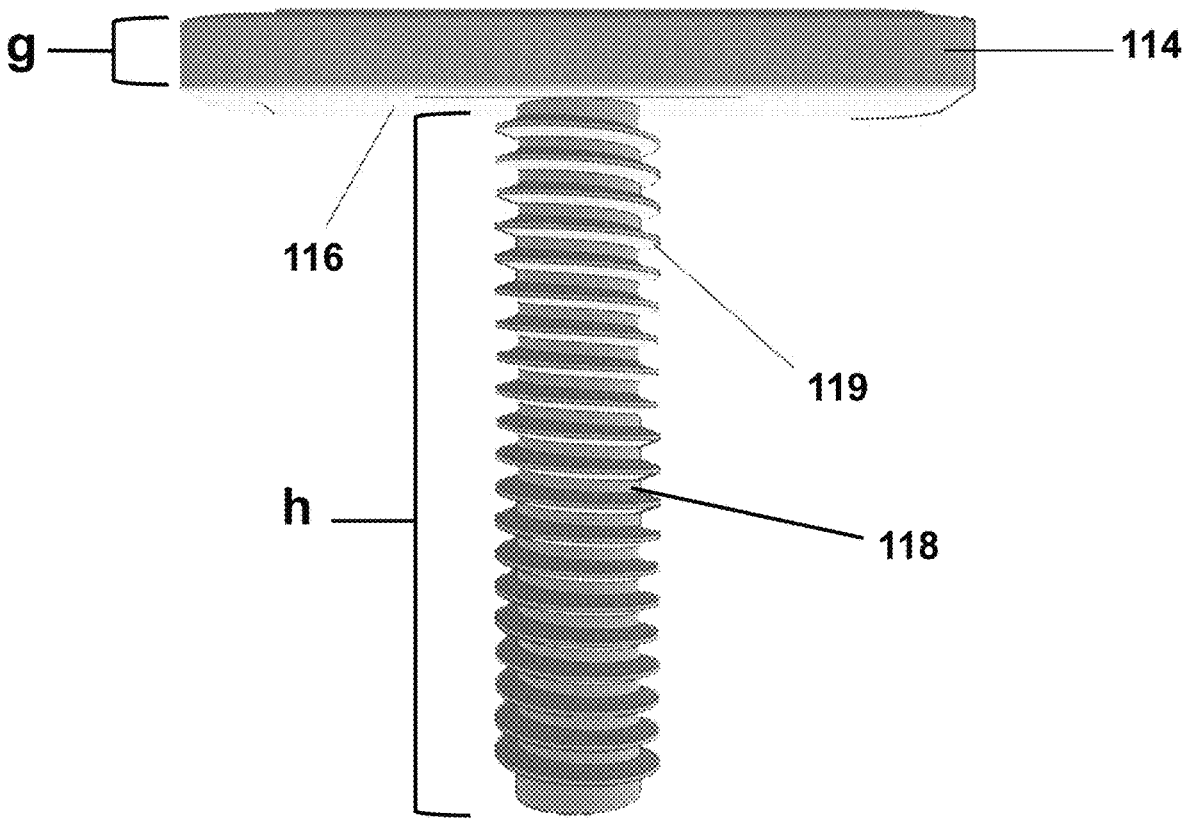
FIG. 4 is a side view of marker stabilizer remover (114) with handle (116) having a top surface, side surfaces, a bottom surface, and height (g). The bottom surface of handle (116) contains medial protrusion (118) having longitudinal length (h) and external threads (119). Marker stabilizer remover (114) can be removably attached to marker stabilizer (108) by contacting external threads (119) of protrusion (118) to internal threads (111) of marker stabilizer (108). Marker stabilizer remover (114) can be used to pull marker stabilizer (108) out of the ground.

The edges of handle (116) may be more or less rounded than shown in FIG. 4. Handle (116) may contain indentations in the side surfaces or bottom surface for gripping with fingers. There may be dots or a line on the top or side surface of handle (116) indicating where to align marker stabilizer remover (114) to twist onto marker stabilizer (108). Aligning the dots or lines on handle (116) and marker stabilizer (108) may facilitate attachment of these two components. External threads (119) can be made up of one or more sets (e.g., 2, 3, 4, or more) of threads, and may be spaced closer together or further apart than shown in FIG. 4.

Marker stabilizer remover (116) may be made of any plastic or metal that can be formed into the shape of a marker stabilizer remover. Materials used to make marker stabilizer remover (114) can be opaque or transparent and can be of any color.

Uses

The marker stabilizer is used to hold and stabilize markers (e.g., driveway markers, garden stakes, or decorations) and can prevent them from falling over or being knocked to the ground. Marker stabilizer (108) is inserted into the ground (e.g., hammered) until the top of the body is flush with the ground. When flush with the ground, marker stabilizer (108) is not easily visible (e.g., cannot be seen from a distance), does not get in the way, and can remain in the ground year round. For use in stabilizing driveway markers, marker stabilizer (108) can be inserted alongside or bordering a driveway, or used to demarcate any other region that can be safely plowed without causing damage to a snow plow. For use in stabilizing garden stakes, marker stabilizer (108) can be inserted in a garden, yard, or any other location in which plants need to be supported or labeled.

Marker stabilizer (108) can be inserted into the ground in anticipation of future use or as needed for immediate use in stabilizing markers. For example, marker stabilizer (108) can be inserted into the ground before snowfall (e.g., before winter or before the ground freezes) for use in holding driveway markers. In another example, marker stabilizer (108) can be inserted into the ground at the time of planting to provide support for young plants or to demarcate areas containing newly planted seeds in a garden. If marker stabilizer (108) is to be used immediately upon installation in the ground, the desired marker (e.g., driveway marker, garden stake, or decoration) can be inserted into interior channel (110) of marker stabilizer (108) (e.g., twisted or slid partially or completely into interior channel (110)) as soon as marker stabilizer (108) is installed in the ground. Marker stabilizers and markers should be paired based on correspondence between the width or diameter of interior channel (110) and the width or diameter of the marker (e.g., the diameter of the marker should be smaller, e.g., slightly smaller, than the diameter of interior channel (110) of marker stabilizer (108)). When the marker is no longer needed, it can be removed from interior channel (110) of marker stabilizer (108) by twisting or pulling. Marker stabilizer (108) can remain in the ground for future use or be removed if desired.

When marker stabilizer (108) is in the ground and not being used to hold a marker (e.g., after a marker has been removed, or before marker stabilizer (108) is needed to hold a marker), it can be covered by cap (100) for protection from dirt, debris, or other environmental particulates (e.g., gravel or small rocks). Cap (100) is attached to marker stabilizer (108) by contacting external threads (104) of medial protrusion (105) of cap (100) to internal threads (111) of interior channel (110) of marker stabilizer (108), and twisting medial protrusion (105) into interior channel (110) until bottom side (106) of cap (100) contacts the top of body (107) of marker stabilizer (108) and forms a seal, as shown in FIG. 5. When it is time for marker stabilizer (108) to be used, cap (100) is removed from marker stabilizer (108) by twisting in the reverse direction until medial protrusion (105) is completely removed from interior channel (110). When cap (100) is removed from marker stabilizer (108), a marker can be inserted into interior channel (110) of marker stabilizer (108) or marker stabilizer (108) can be removed from the ground.

To remove marker stabilizer (108) from the ground (e.g., for relocation or when no longer needed), contact external threads (119) of medial protrusion (118) of marker stabilizer remover (114) to internal threads (111) of interior channel (110) of marker stabilizer (108) and twist using handle (116) until medial protrusion (118) of marker stabilizer remover (114) is partially inserted (e.g., one quarter, one half, or three quarters of length (h) inserted) into interior channel (110) of marker stabilizer (108), as shown in FIG. 7. To remove marker stabilizer (108), pull on handle (116) until marker stabilizer (108) is completely removed from the ground. Marker stabilizer remover (114) is removed from marker stabilizer (108) by twisting handle (116) in the reverse direction of that used for attachment until medial protrusion (118) of marker stabilizer remover (114) is completely removed from interior channel (110) of marker stabilizer (108). If desired, marker stabilizer (108) can be inserted in a new location to stabilize a marker using the methods described herein above.

Marker stabilizer (108) can also be used to stabilize decorations (e.g., holiday decorations). For example, marker stabilizer (108) can be used to hold Christmas decorations (e.g., candy canes, reindeer, or snowmen) that are fitted for insertion into interior channel (110) of marker stabilizer (108). Marker stabilizer (108) can remain in the ground year round and hold different seasonal or holiday-related decorations during different times of the year. Cap (100) can be used to protect marker stabilizer (108) when it is not being used to hold decorations as described herein above.

Kits

The devices and systems described herein can be provided in a kit for use in stabilizing markers (e.g., driveway markers, garden stakes, or decorations). Kits may include one or more (e.g., 2, 3, 4, 6, 8, 10, 12, 14, 16, 18, 20 or more) marker stabilizers, one or more (e.g., 2, 3, 4, 6, 8, 10, 12, 14, 16, 18, 20 or more) caps, and one or more (e.g., 2, 3, 4, 5, or more) marker stabilizer removers described herein. The marker stabilizers, caps, and marker stabilizer removers in a given kit can be made of a single material (e.g., metal or plastic) or the kit can include marker stabilizers, caps, and marker stabilizer removers made of metal and others made of plastic. Marker stabilizers, caps, and marker stabilizer removers can be opaque or transparent and can be of any color. The kit can also include markers (e.g., driveway markers, garden stakes, or decorations) appropriate for use with the marker stabilizers. The kit can further include a package insert that instructs a user of the kit to perform the methods described herein.

EXAMPLES

Example 1. Installation of Driveway Markers

The systems described herein may be used to stabilize driveway markers to demarcate a driveway when snow is on the ground. A homeowner or landlord inserts (e.g., hammers) one or more (e.g., 2, 3, 4, 5, 6, 7, 8, 9, 10, or more) marker stabilizers (108) into the ground along each side of a driveway such that the top of each marker stabilizer (108) is flush with the ground. Marker stabilizers are inserted during the fall before the ground freezes. Cap (100) is attached to each marker stabilizer (108) by twisting external threads (104) of medial protrusion (105) of cap (100) into internal threads (111) of interior channel (110) of marker stabilizer (108) until bottom side (106) of cap (100) contacts the top of body (107) of marker stabilizer (108) and forms a seal. When snow on the ground obscures the driveway, snow is removed from cap (100), which is then removed from marker stabilizer (108) by twisting in the reverse direction of that used for attachment until medial protrusion (105) of cap (100) is completely removed from interior channel (110) of marker stabilizer (108). Driveway markers with a diameter that is slightly less than that of interior channel (110) of marker stabilizer (108) are then inserted into each marker stabilizer by sliding a driveway marker completely into interior channel (110), such that it extends through an entire length of interior channel (110). When winter is over, driveway markers are removed by pulling markers up and out of interior channel (110) of marker stabilizer (108). Cap (100) is re-attached to marker stabilizer (108) as described above to protect marker stabilizer (108) until it is needed again.

OTHER EMBODIMENTS

While the invention has been described in connection with specific embodiments thereof, it will be understood that it is capable of further modifications and this application is intended to cover any variations, uses, or adaptations of the invention following, in general, the principles of the invention and including such departures from the invention that come within known or customary practice within the art to which the invention pertains and may be applied to the essential features hereinbefore set forth, and follows in the scope of the claims.

Other embodiments are within the claims.

The invention claimed is:

1. A system comprising:

a) a marker stabilizer for insertion into the ground, wherein the stabilizer comprises a body comprising a proximal end with an open top and a distal end with a closed, pointed tip, wherein the body comprises an interior channel extending longitudinally through the proximal end and through at least a portion of the body, and wherein the interior channel comprises internal threads through all or a portion of the interior channel, and b) interchangeable parts selected from a cap and a marker stabilizer remover that are available for insertion through the open top and into the interior channel of the marker stabilizer, wherein the cap comprises a top surface and a bottom surface, wherein the bottom surface comprises a medial protrusion having a longitudinal length and comprising external threads along the longitudinal length, and wherein the cap is configured to be removably attached to the marker stabilizer by insertion of the medial protrusion of the cap through the open top and into the interior channel of the marker stabilizer with twisting to contact the external threads of the medial protrusion of the cap to the internal threads of the interior channel of the marker stabilizer, and wherein the marker stabilizer remover comprises a handle having a top surface, side surfaces, and a bottom surface comprising a medial protrusion having a longitudinal length and comprising external threads along the longitudinal length, wherein the medial protrusion of the marker stabilizer remover is configured to be removably attached to the marker stabilizer by insertion of the medial protrusion of the marker stabilizer remover through the open top and into the interior channel of the marker stabilizer with twisting to contact the external threads of the medial protrusion of the marker stabilizer remover to the internal threads of the interior channel of the marker stabilizer.

2. The system of claim 1, wherein:

a) the marker stabilizer has:
  i) a length of 10 cm to 20 cm;
  ii) a diameter of 1 cm to 5 cm; and/or
  iii) a round, square, triangular, or multi-sided body; and/or b) the internal threads:
  i) begin at the top of the body; and/or
  ii) extend through an entire length of the interior channel; and/or c) the interior channel has:
  i) a length of 8 cm to 15 cm; and/or
  ii) a diameter of 0.5 cm to 1.5 cm; and/or d) the closed tip:
  i) is solid; and/or
  ii) has angled sides that terminate in one or more points; and/or e) the cap:
  i) has a diameter of 0.25 cm to 5 cm;
  ii) has a height of 0.25 cm to 2 cm; and/or
  iii) is in the shape of a circle, square, or oval, or is multi-sided; and/or f) the medial protrusion of the cap:
  i) has a diameter of 0.25 cm to 2 cm; and/or
  ii) has a length of 0.25 cm to 2 cm; and/or g) the bottom side of the cap is configured to contact the top of the marker stabilizer and form a seal when the medial protrusion is engaged in the interior channel.

3. The system of claim 1, wherein the closed tip terminates in the shape of an "x" or the shape of a "+."

4. The system of claim 1, wherein the system further comprises a marker, wherein the marker comprises a shaft having a longitudinal length sized for insertion through the open top and into the interior channel of the marker stabilizer, wherein the marker is configured to be removably inserted into the interior channel of the marker stabilizer and extend through all or a portion of the interior channel when neither the cap nor the marker stabilizer remover is inserted into the interior channel of the marker stabilizer.

5. The system of claim 4, wherein the marker:

a) extends through an entire length of the interior channel;
b) is a driveway marker; or
c) is a garden stake or decoration.

6. The system of claim 1, wherein:

a) the handle:
  i) has a width of 0.5 cm to 4 cm;
  ii) has a length of 0.5 cm to 10 cm;
  iii) has a height of 0.25 cm to 2 cm; and/or
  iv) comprises indentations configured for gripping with fingers; and/or b) the medial protrusion of the remover:
  i) has a diameter of 0.5 cm to 2 cm;
  ii) has a length of 1 cm to 10 cm; and/or
  iii) is configured to partially extend into the interior channel of the marker stabilizer when the medial protrusion is engaged in the interior channel.

7. The system of claim 1, wherein the marker stabilizer, cap, or marker stabilizer remover is made of plastic or metal.

8. A method for using a marker stabilizer system, wherein the marker stabilizer system comprises:

a) a marker stabilizer for insertion into the ground, wherein the marker stabilizer comprises a body comprising a proximal end with an open top and a distal end with a closed, pointed tip, wherein the body comprises an interior channel extending longitudinally through the proximal end and through at least a portion of the body, and wherein the interior channel comprises internal threads through all or a portion of the interior channel, wherein the marker stabilizer is configured to support a marker comprising a shaft having a longitudinal length sized for insertion through the open top and into the interior channel of the marker stabilizer, and b) interchangeable parts selected from a cap and a marker stabilizer remover that are available for insertion through the open top and into the interior channel of the marker stabilizer, wherein the cap comprises a top surface and a bottom surface, wherein the bottom surface comprises a medial protrusion having a longitudinal length and comprising external threads along the longitudinal length, wherein the cap is configured to be removably attached to the marker stabilizer by insertion of the medial protrusion of the cap through the open top and into the interior channel of the marker stabilizer, and wherein the marker stabilizer remover comprises a handle having a top surface, side surfaces, and a bottom surface comprising a medial protrusion having a longitudinal length and comprising external threads along the longitudinal length, wherein the medial protrusion of the marker stabilizer remover is configured to be removably attached to the marker stabilizer by insertion of the medial protrusion of the marker stabilizer remover through the open top and into the interior channel of the marker stabilizer, wherein the method comprises:

(a) inserting the marker stabilizer into the ground until the top of the stabilizer is substantially flush with the ground (b)
  i) inserting the marker through the open top and into the interior channel of the marker stabilizer, and removing the marker from the interior channel of the marker stabilizer; or
  ii) inserting the cap through the open top and into the interior channel of the marker stabilizer with twisting to contact the external threads of the medial protrusion of the cap to the internal threads of the interior channel of the marker stabilizer, and removing the cap from the interior channel of the marker stabilizer; or iii) performing, in either order and one or more times b) i) and b) ii); and (c) inserting the medial protrusion of the marker stabilizer remover through the open top and into the interior channel of the marker stabilizer with twisting to contact the external threads of the medial protrusion of the marker stabilizer remover to the internal threads of the interior channel of the marker stabilizer, gripping the handle of the marker stabilizer remover, and pulling up on the handle until the marker stabilizer is completely removed from the ground.

9. The method of claim 8, wherein the method further comprises twisting the medial protrusion of the cap into the interior channel of the marker stabilizer until the bottom surface of the cap contacts the top of the marker stabilizer and forms a seal.

10. The method of claim 8, wherein the method further comprises twisting the marker stabilizer remover in the opposite direction until the medial protrusion of the marker stabilizer remover is fully removed from the interior channel of the marker stabilizer.

11. The method of claim 8, wherein:

a) the cap:
- i) has a diameter of 0.25 cm to 5 cm;
- ii) has a height of 0.25 cm to 2 cm; and/or
- iii) is in the shape of a circle, square, or oval, or is multi-sided; and/or b) the medial protrusion of the cap:
- i) has a diameter of 0.25 cm to 2 cm; and/or
- ii) a length of 0.25 cm to 2 cm; and/or c) the handle:
- i) has a width of 0.5 cm to 4 cm;
- ii) has a length of 0.5 cm to 10 cm;
- ii) has a height of 0.25 cm to 2 cm; and/or
- iv) comprises indentations configured for gripping with fingers; and/or d) the medial protrusion of the marker stabilizer remover:
- i) has a diameter of 0.5 cm to 2 cm; and/or
- ii) has a length of 1 cm to 10 cm.

12. The method of claim 8, wherein the marker is a driveway marker, garden stake, or decoration.

13. The method of claim 8, wherein:

a) the marker stabilizer has:
- i) a length of 10 cm to 20 cm; and/or
- ii) a diameter of 1 cm to 5 cm; and/or b) the internal threads:
- i) begin at the top of the body; and/or
- ii) extend through an entire length of the interior channel; and/or c) the interior channel has:
- i) a length of 8 cm to 15 cm; and/or
- ii) a diameter of 0.5 cm to 1.5 cm; and/or d) the body of the marker stabilizer is round, square, triangular, or multi-sided; and/or e) the closed tip:
- i) is solid; and/or
- ii) has angled sides that terminate in one or more points.

14. The method of claim 13, wherein the closed tip terminates in the shape of an "x" or the shape of a "+."

15. The method of claim 8, wherein the marker extends through an entire length of the interior channel.

16. The method of claim 8, wherein the marker stabilizer, cap, or marker stabilizer remover is made of plastic or metal.

17. A marker stabilizer kit comprising:

a) a marker stabilizer for insertion into the ground, wherein the stabilizer comprises a body comprising a proximal end with an open top and a distal end with a closed, pointed tip, wherein the body comprises an interior channel extending longitudinally through the proximal end and through at least a portion of the body, and wherein the interior channel comprises internal threads through all or a portion of the interior channel, wherein the marker stabilizer is configured to support a marker comprising a shaft having a longitudinal length sized for insertion through the open top and into the interior channel of the marker stabilizer; and b) interchangeable parts selected from a cap, a marker stabilizer remover, and, optionally, the marker that are available for insertion through the open top and into the interior channel of the marker stabilizer, wherein the cap comprises a top surface and a bottom surface, wherein the bottom surface comprises a medial protrusion having a longitudinal length and comprising external threads along the longitudinal length, and wherein the cap is configured to be removably attached to the marker stabilizer by insertion of the medial protrusion of the cap through the open top and into the interior channel of the marker stabilizer with twisting to contact the external threads of the medial protrusion of the cap to the internal threads of the interior channel of the marker stabilizer, and wherein the marker stabilizer remover comprises a handle having a top surface, side surfaces, and a bottom surface comprising a medial protrusion having a longitudinal length and comprising external threads along the longitudinal length, and wherein the marker stabilizer remover is configured to be removably attached to the marker stabilizer by insertion of the medial protrusion of the marker stabilizer remover through the open top and into the interior channel of the marker stabilizer with twisting to contact the external threads of the medial protrusion of the marker stabilizer remover to the internal threads of the interior channel of the marker stabilizer.

18. The kit of claim 17, wherein the kit further comprises the marker, wherein the marker comprises a shaft having a longitudinal length sized for insertion through the open top and into the interior channel of the marker stabilizer, wherein the marker is configured to be removably inserted into the interior channel of the marker stabilizer and extend through all or a portion of the interior channel.

19. The kit of claim 17, wherein the kit further comprises instructions for use of the marker stabilizer kit.

* * * * *